US009267753B2

(12) United States Patent
Dextraze et al.

(10) Patent No.: US 9,267,753 B2
(45) Date of Patent: Feb. 23, 2016

(54) RECOIL FORCE MITIGATING DEVICE FOR FIREARMS

(71) Applicant: Cadex, Inc., Quebec (CA)

(72) Inventors: Serge Dextraze, St-Jean-sur-Richelieu (CA); Erich Lopez, Chambly (CA)

(73) Assignee: Cadex, Inc., Quebec (CA)

( * ) Notice: Subject to any disclaimer, the term of this patent is extended or adjusted under 35 U.S.C. 154(b) by 392 days.

(21) Appl. No.: 13/628,183

(22) Filed: Sep. 27, 2012

(65) Prior Publication Data

US 2014/0059908 A1 Mar. 6, 2014

Related U.S. Application Data

(60) Provisional application No. 61/540,514, filed on Sep. 28, 2011.

(51) Int. Cl.

| | |
|---|---|
| ***F41A 21/00*** | (2006.01) |
| ***F41A 25/10*** | (2006.01) |
| ***F41G 11/00*** | (2006.01) |

(52) U.S. Cl.

CPC ..... *F41A 25/10* (2013.01); *F41G 11/002* (2013.01); *F41G 11/003* (2013.01)

(58) Field of Classification Search

CPC ..... F41G 11/002; F41G 11/003; F41C 27/00; F41C 23/06; F41A 25/10

USPC ..... 42/124, 127, 1.06

See application file for complete search history.

(56) References Cited

U.S. PATENT DOCUMENTS

| | | | | | |
|---|---|---|---|---|---|
| 2,450,466 | A | * | 10/1948 | Carlson | 42/127 |
| 2,597,466 | A | | 5/1952 | Felix | |
| 3,205,580 | A | | 9/1965 | Osborn | |
| 3,483,623 | A | | 12/1969 | Kruzell | |
| 3,579,840 | A | | 5/1971 | Heinzel | |
| 3,969,982 | A | * | 7/1976 | Pier-Amory et al. | 89/178 |
| 4,026,054 | A | * | 5/1977 | Snyder | 42/115 |
| 4,027,414 | A | | 6/1977 | Felix | |
| 4,446,644 | A | | 5/1984 | Jimenez et al. | |
| 5,142,806 | A | | 9/1992 | Swan | |
| 5,276,988 | A | | 1/1994 | Swan | |
| 5,396,725 | A | | 3/1995 | Talbot | |
| 5,425,191 | A | | 6/1995 | Taylor et al. | |
| 5,531,039 | A | * | 7/1996 | Gore | 42/124 |
| 5,669,173 | A | | 9/1997 | Rodney, Jr. | |
| D435,885 | S | | 1/2001 | Wallace | |
| 6,594,938 | B2 | | 7/2003 | Horton | |
| 6,678,988 | B1 | * | 1/2004 | Poff, Jr. | 42/147 |
| 6,822,791 | B2 | * | 11/2004 | Recknagel | 359/405 |
| 8,011,130 | B2 | | 9/2011 | Chang et al. | |
| 8,117,781 | B2 | | 2/2012 | Dextraze | |
| 8,205,375 | B1 | | 6/2012 | Swan | |
| 8,499,484 | B2 | * | 8/2013 | Schneider et al. | 42/124 |
| 2004/0009034 | A1 | * | 1/2004 | Miller | 403/363 |

* cited by examiner

*Primary Examiner* — Samir Abdosh

(74) *Attorney, Agent, or Firm* — FisherBroyles, LLP; Rachel Huffstetler; Anthony DoVale

(57) ABSTRACT

A recoil force mitigating device for cooperating with a firearm to mitigate recoil forces imparting undesirable forces to mounted firearm accessories. The recoil force mitigating device includes a recoil rail assembly having a first rail for mounting to the firearm and a slideable second rail for mounting accessories. A recoil force mitigating means is positioned between the first and second rails to mitigate transfer of forces, such as recoil forces, from the first rail to the second rail.

41 Claims, 15 Drawing Sheets

RECOIL FORCE MITIGATING DEVICE FOR FIREARMS

CONTINUITY DATA

This application claims priority to and the benefit of U.S. Provisional Patent Application No. 61/540,514, filed on Sep. 28, 2011, which is incorporated herein in its entirety.

FIELD OF THE INVENTION

This invention relates generally to firearms, and more particularly to a shock mitigating device for cooperating with the firearm to mitigate recoil forces imparting undesirable forces to, for example, mounted firearm accessories.

BACKGROUND OF THE INVENTION

Modern firearms, including those employed in military and law enforcement applications, often include various accessories to assist the shooter. Such devices include costly and mechanically precise instruments including precision optics and electronics, hereinafter referred to as "electro-optic devices". Electro-optic devices may be mounted directly to the firearm or indirectly on a mount associated with the firearm. Conventional mounting means include securing accessories to the firearm with a Picatinny rail system. Electro-optic devices include, but are not limited to, day scopes and night vision devices, infrared views, cameras and illuminators. While the shock mitigating devices as described herein are particularly beneficial for electro-optic devices, beneficial mitigation can be achieved for protecting any device, the firearm, and/or the shooter.

Under firing conditions, devices, particularly electro-optic devices, can sustain damage in many ways. One source of damage is from recoil forces (often called kickback or simply kick) which are the backward momentum of a gun when it is discharged. In most small arms, the momentum is transferred to the ground through the body of the shooter, while in heavier guns, such as mounted machine guns, the momentum is transferred to the ground through its mount. Under firing conditions, electro-optics can be damaged in a number of ways. Recoil forces can cause the body of a day scope to flex, resulting in shifting of optical lenses and reticles. With regard to night vision, laser and white light devices, the precision circuitry of electro-optics can be damaged by the shock of firing forces. The shock mitigating device according to the present invention is directed to mitigating such recoil forces on a firearm to prevent damage to electro-optic devices.

SUMMARY

Presented herein is a shock mitigating device for cooperating with a firearm in the form of a recoil rail assembly which mitigates the aforementioned recoil forces and protects firearm accessories and the firearm. The recoil forces are mitigated by the recoil rail assembly of the present invention which buffers and absorbs variable amounts of peak recoil forces, thereby reducing the forces transferred from the firearm firing, to any accessories, such as electro-optic devices. The recoil rail assembly as described herein contemplates use on all weapon types; from light, portable, infantry weapons to heavy infantry weapons, such as a .50 caliber machine gun. Even a fixedly mounted firearm would benefit from the present invention.

More specifically, the recoil rail assembly according to the present invention includes a novel method of buffering recoil forces within a recoil rail assembly so as to mitigate transferred forces to any accessories, a novel configuration for absorbing forces, and a novel mounting configuration for mounting the rail assembly to the firearm. Moreover, the recoil rail assembly is designed to provide custom mitigation properties to protect a wide range of electro-optic devices and for cooperating with a variety of firearm types. For example, less mitigation is needed for lighter firearms. Buffer configurations can be modified for different size, shape and mass requirements for multiple types of electro-optic devices and for various firearm characteristics.

The recoil rail assembly according to various embodiments includes a base, or first rail, for mounting to the firearm, a second rail slideable along a longitudinal axis of and relative to the base rail, a recoil force mitigating member housed within a cavity defined between the first and second rail, and mounting means for mounting the recoil rail assembly to the firearm. Various embodiments described herein differ with regard to the mounting means, the recoil force mitigating member, and configuration of the recoil rail assembly. According to various embodiments, the recoil rail assembly has a novel configuration for slideably securing the second rail with the first rail including providing a pair of relatively shorter sliding blocks having outwardly extending guide tabs or extensions, a pair of relatively shorter sliding blocks defining a guide shaft, a longitudinally extending single mating member with outwardly extending guide tabs, or a guide rod for slideably securing the first and second rails.

Novel recoil force mitigating means, according to one embodiment, are beneficial, for example, for long travel and include a central, longitudinally extending shaft and a pair of springs for absorbing recoil forces. This arrangement provides long, gradual curve to manage recoil forces and the spring rate may be altered to accommodate different firearm firing rates and enables the recoil reset rate to be matched with the weapon. A second recoil force mitigating means described herein is beneficial, for example, for a shorter travel. This embodiment includes at least one or more deformable, elastomeric members positioned in a predetermined location to mitigate recoil forces by deforming and absorbing the forces and provide protection to accessories mounted on the second rail. This embodiment utilizes a short moment curve to mitigate recoil forces. Another embodiment utilizes a combination of a spring or springs and an elastomeric member or members to mitigate recoil forces and minimize or prevent transference thereof to the second rail supporting the accessories.

As described herein, various mounting arrangements may be employed for mounting the recoil rail assembly to the firearm. In one aspect, the recoil rail assembly is mounted directly onto the weapon or recipient platform in which case a lower rail assembly profile results. According to another aspect, the base or first rail includes a mounting bracket having a screw pattern for cooperating with screw hole patterns on the firearm or recipient platform. Another aspect includes a novel bracket for cooperating with a conventional Picatinny rail or other attaching surface on the firearm or recipient platform.

While certain combinations of the various rail configurations, recoil force mitigating members, and mounting configurations are illustrated and described in detail below, it is to be understood that different permeations of these variables are within the scope of the present invention. That is, any of the various rail configurations may be used in combination with any one of the force mitigating means and any of these combinations may be mounted to the firearm utilizing any of the described mounting means. Additionally, the mitigating means can buffer or mitigate forces in both the aft and fore direction, or just one direction.

A shock mitigating device as described herein provides savings in life cycle costs such as in-service and a reduction of wear and tear on electro-optic devices' image intensifier tubes, optical lenses, battery housings and electronics. Moreover, the weight of the electro-optic device may be reduced because fewer recoil forces will be absorbed. Weight savings can also be achieved because less weight will be necessary to harden image intensifier tubes, optical lenses and electronics to manage shock. In addition to providing life cycle cost savings, the present invention also provides commonality of training and commonality of logistics. The shock mitigating device as described herein allows an electro-optic device to be used across greater variety of weapon systems, with different recoil characteristics. For example, the same electro-optic device may be used on different weapons such as a carbine and on a heavy machine gun. The recoil rail assembly, according to the present invention, enables weapon designers to create lighter weapon designs as less emphasis is needed on absorption of shock by devices mounted to the weapon platform. The recoil rail may be integrated with future powered rail systems whereby recoil rail designs will maintain circuit continuity between power sources and attached electro-optic/accessory devices. Additionally, the recoil rail assembly allows integration of items such as grenade launchers and shotguns to a parent weapon, with reduction of shock risk to electro-optic accessories. The recoil rail assembly also ensures there is little or no movement of the electro-optic accessory due to shock when the weapon or weapon subsystem is fired.

Cumulative effects of shock can also weaken retention springs in the battery housing, resulting in a failure of the power source. Firing forces can cause the battery to move within the battery housing causing loss of continuity and resulting in failures such as system shut down or reboot of electro-optic system. Electronic components can be affected by short and long term effects of weapon firing shock. Reticles and lenses can be shifted by cumulative effects of firing shock or by a significant impact event under field conditions. The result may be a loss of zero or a complete failure of the optical path. Forces acting on the electro-optic selector switches, controls and zeroing mechanisms may also be impacted by recoil forces. These risks are reduced and/or eliminated by the present invention.

Other benefits are achieved to the weapon itself in that the weapon itself absorbs less force when recoil forces are mitigated by a recoil rail assembly. For example, electro-optic devices mounted on heavy weapons on a vehicle or aircraft are subject to vibration during operation of the vehicle/aircraft. The recoil rail provides a degree of mitigation from the frequency of vibrations from forces in addition to recoil forces. Moreover, under field conditions, impact forces during use can be enough to damage accessory mounting brackets, or cause shifting of reticle or lens. Forces can shake batteries to cause system shut down, reboot of electro-optics, or cause an electro-optic system to shut down. An electro-optic device using a recoil rail assembly has increased chance to survive such an impact event. These and other benefits and advantages are provided by the shock mitigating device as described in more detail below.

DESCRIPTION OF THE FIGURES

The accompanying drawings, which are incorporated in and constitute a part of this specification, illustrate certain aspects of the instant invention and together with the description, serve to explain, without limitation, the principles of the invention.

DETAILED DESCRIPTION OF THE INVENTION

Figure 1:
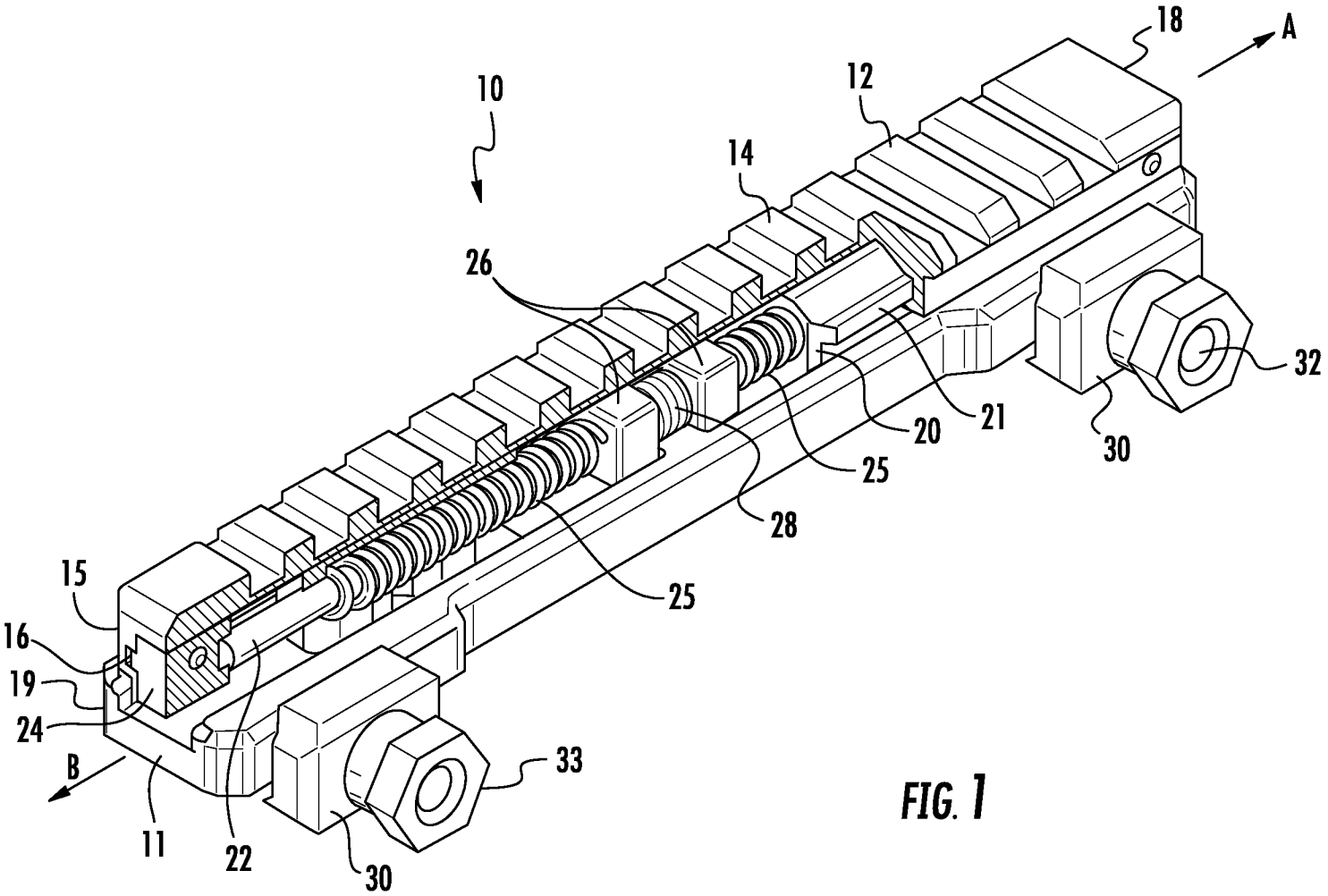
FIG. 1 is a perspective view, partially broken away, of a first embodiment of a recoil force mitigating device for a firearm as presented herein.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "rail" includes aspects having two or more rails unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Presented herein is a recoil force mitigating device for cooperating with a firearm to mitigate recoil forces and protect any firearm accessories, such as electro-optic devices, from damage due to the transfer of recoil forces. This is accomplished according the various embodiments described herein by providing a recoil rail assembly including a base, or first rail, for mounting to a firearm, a second rail which is slideable along the longitudinal axis of and relative to the first rail, mitigating means for mitigating recoil forces housed within the rail assembly, and mounting means for mounting the recoil force mitigating device base to the firearm. While certain combinations of each are described herein, it is contemplated that other combinations can be made with respect to these features without departing from the scope of the present invention.

Figure 2:
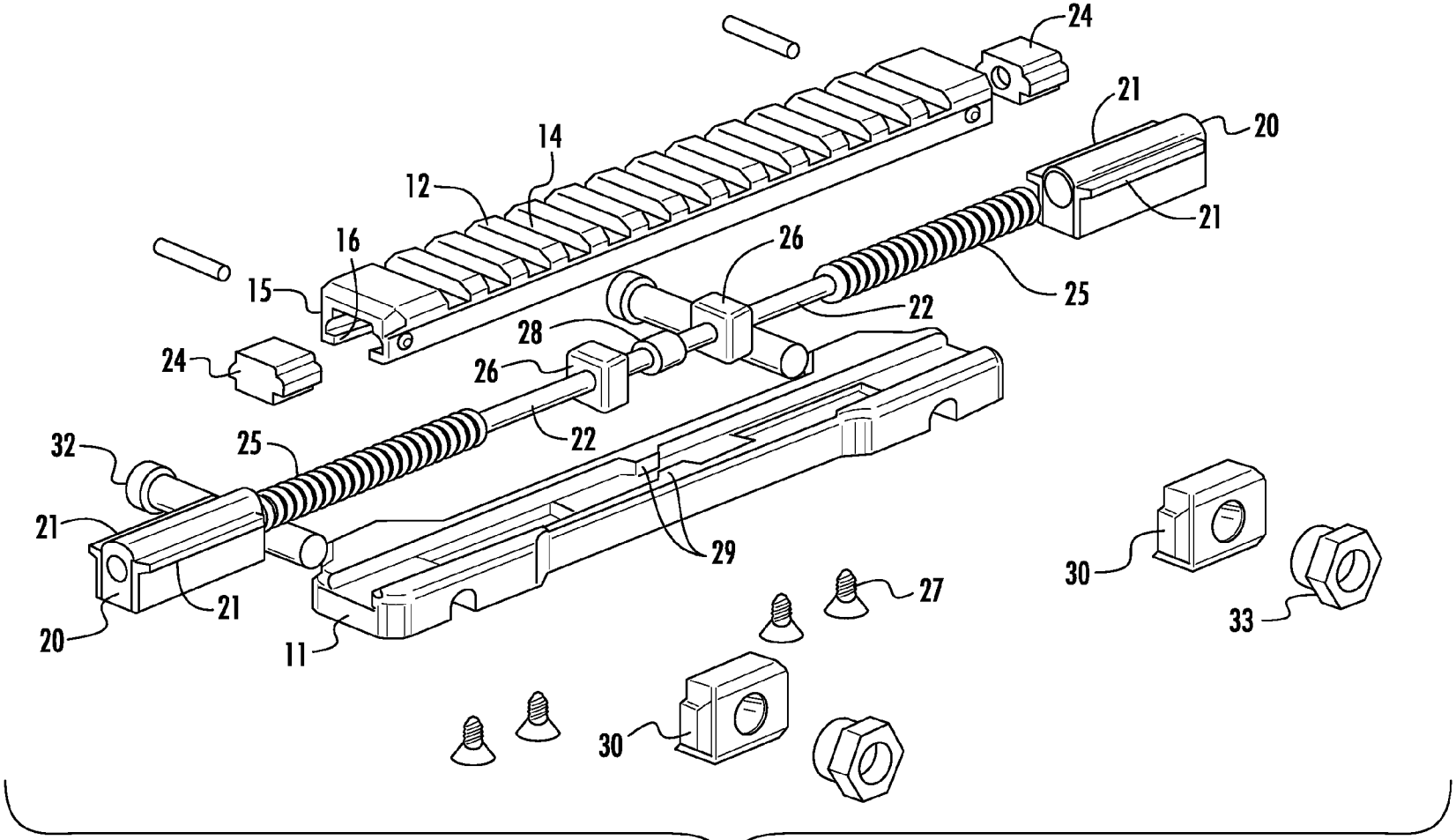
FIG. 2 is an exploded perspective view of the embodiment of FIG. 1.
Figure 3A:
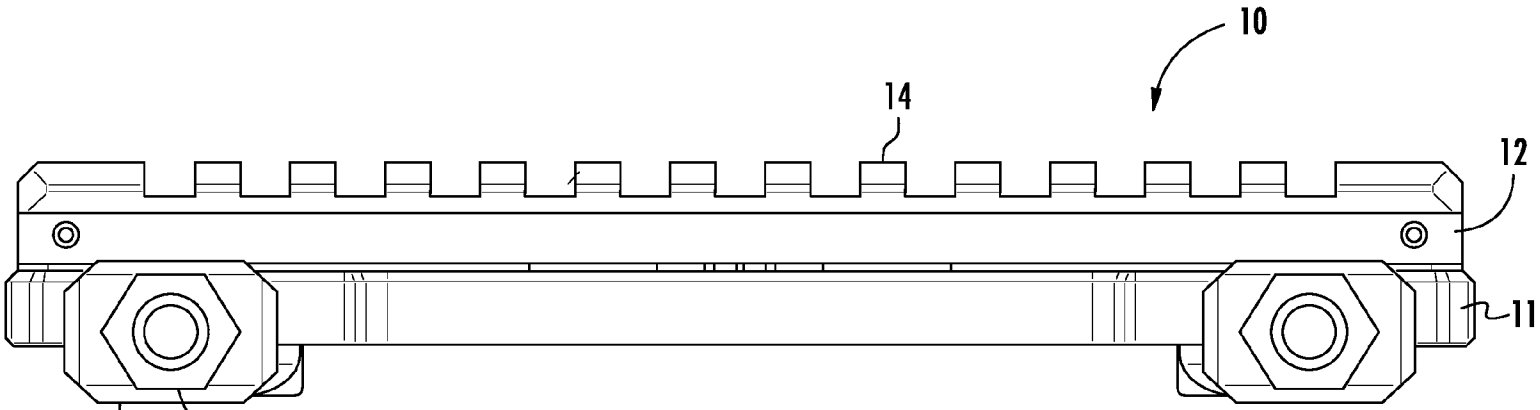
FIG. 3A is a side elevation view thereof.
Figure 3B:
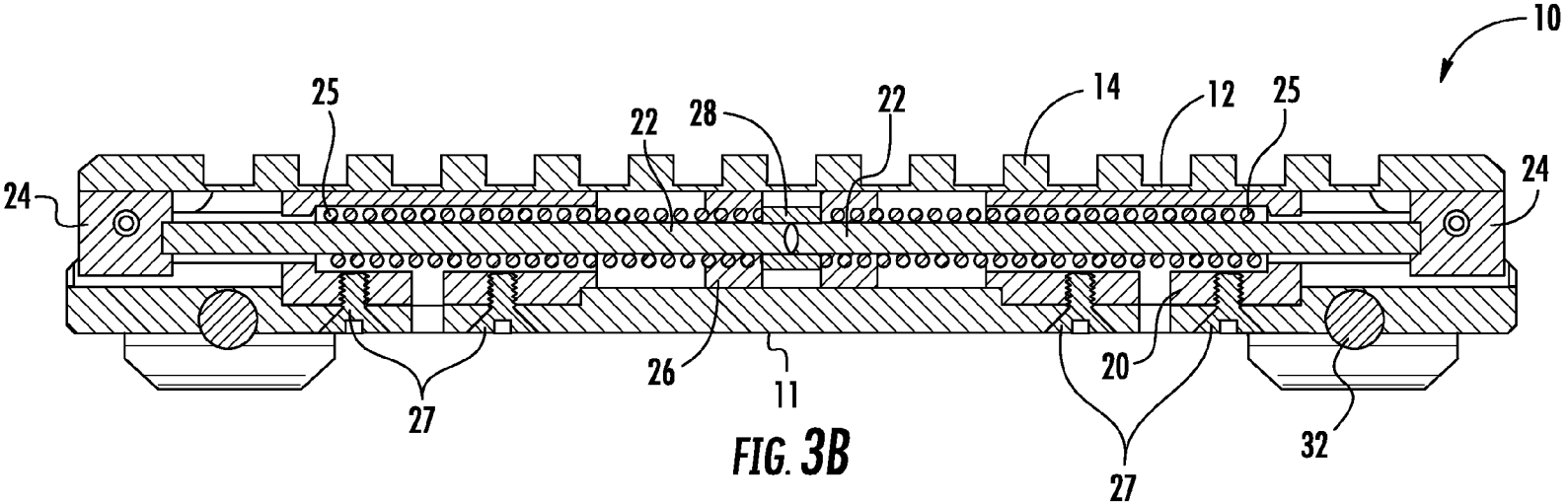
FIG. 3B is a cross-section, side elevation view thereof.

In a first embodiment, as illustrated in FIG. 1, the recoil rail assembly 10 includes a first, or base, rail 11 and a second rail 12 slideably mounted upon base rail 11. The second rail 12 is configured with an upper surface 14 for supporting accessories thereon, and side walls 15 each having an inwardly extending flange 16. The first rail 11 has a first, fore end 18 facing in the direction A of bullet discharge, and a second, aft end 19 facing in the direction B of the shooter. The base rail 11 is configured to receive a pair of blocks 20 which define at least one, and preferably a pair, of longitudinally and outwardly extending flanges 21 as shown in FIGS. 1 and 2. The flanges 16 of the second rail 12 are configured to mate with the block flanges 21 so as to secure the second rail 12 thereon in a slideable manner, and also to stabilize the second rail 12 and eliminate longitudinal rotation thereof. Accordingly, the first rail 11 and second rail 12 define a cavity there between for housing the recoil force mitigating means.

The recoil rail assembly 10 further includes a central shaft 22 and two supporting members or stops 24 on both ends of the shaft 22. The central shaft 22 passes through blocks 20. According to this exemplary embodiment, the recoil force mitigating means includes a pair of springs 25; one positioned between a central support 26 and the respective block 20 adjacent the second rail fore end 18 and another between the other central support 26 and the second rail aft end 19 as shown in FIG. 1. The springs 25 are positioned upon the central shaft 22. As shown, a pair of dampening coil springs are shown, however, other elastically deformable material capable of absorbing recoil forces as generated by the firearm may be employed. Also, any number of springs, or a single spring may be employed. Both blocks 20 are attached individually to the base rail 11 with two screws 27. A bushing 28 is fixed at the center of the shaft 22.

In operation, recoil forces generated by the firearm discharge is lessened or eliminated as the recoil force mitigating means absorbs the recoil forces and prevents its transfer from the first rail 11 to the second rail 12 supporting any structurally precise and/or fragile devices mounted thereon. Specifically, recoil forces directed in the aft direction 19 due to charging of the firearm causes aft movement of the firearm and the base rail 11, compressing the aft spring 25. The second rail 11 remains substantially in a neutral position thereby minimizing substantial movement and transfer of recoil forces to any accessories mounted thereon. When a shock occurs, the second rail 12 moves to the fore end 18 relative to the shaft 22. The bushing 28 that is secured to the shaft 22 carries the central stopper or support 26 and compresses the aft spring 25. When the force applied by the spring 25 is enough to absorb the recoil force, the spring releases, thereby returning the rail 12 substantially to a neutral position and the central stopper 26 abuts the bump or protrusion 29 on the middle of the first rail 11 to prevent over-correction. If the recoil force is not totally absorbed, the second rail 12 moves in the reverse or aft direction wherein the second fore spring 25 is compressed until forces are absorbed and mitigated with the same action as described above until the second rail 12 resumes a neutral position. Preferably, one spring 25 is compressed to absorb the recoil force; the other spring is not compressed and remains with the same force as in the neutral position.

To mount the recoil rail assembly to a weapon, according to the exemplary configuration depicted, two locking wedges 30 are positioned at both extremities of the assembly. They are attached with a positioning stud 32 and locked in place with a locking nut 33. Other devices such a quick detach system can be used to mount the recoil rail assembly to a firearm. The recoil rail base 11 can be mounted directly to a firearm or a firearm accessory with the use of screws or it can be machined directly to the firearm or firearm accessory.

Figure 4:
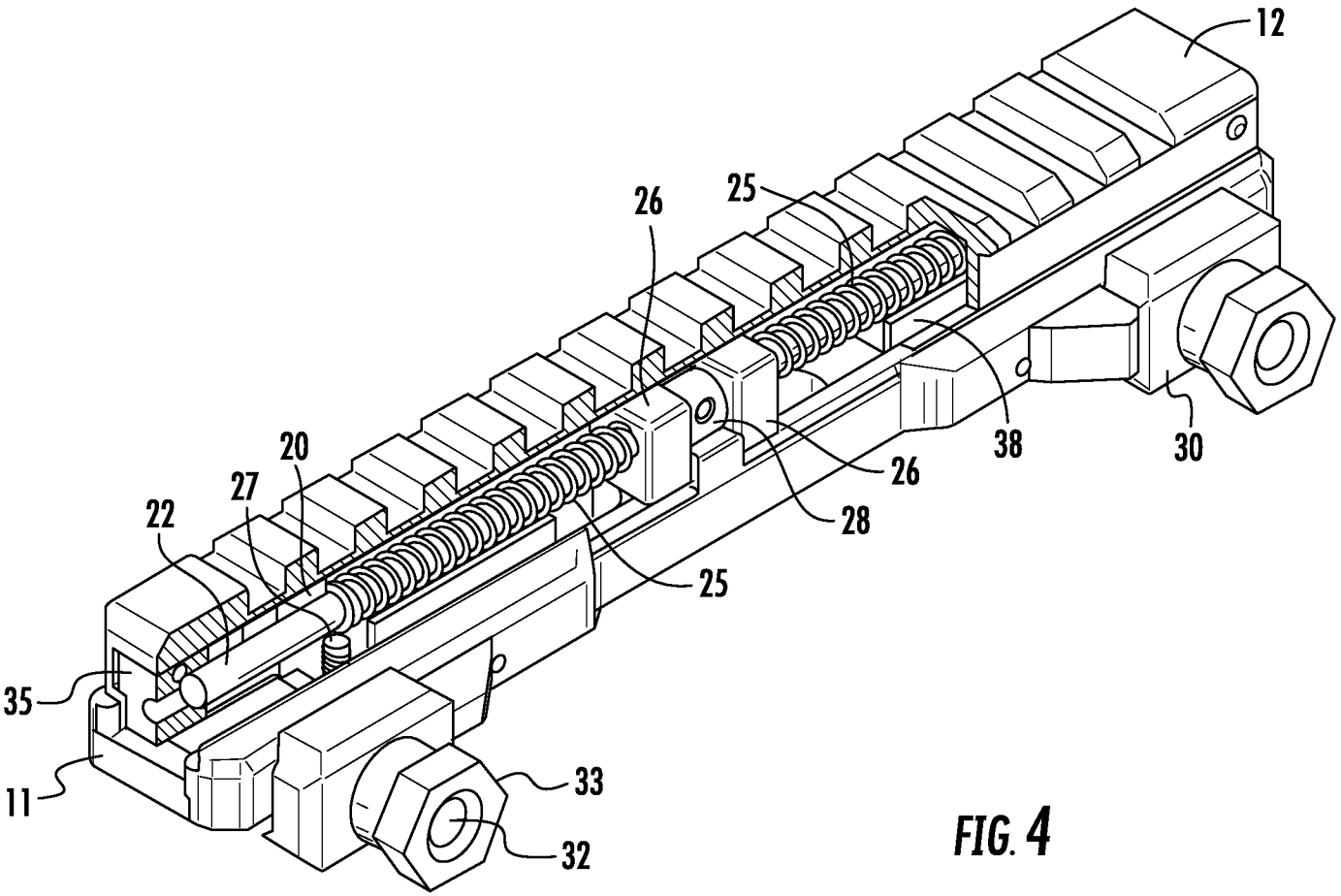
FIG. 4 is a perspective view, partially broken away, of a second embodiment of a recoil force mitigating device for a firearm as presented herein.
Figure 5:
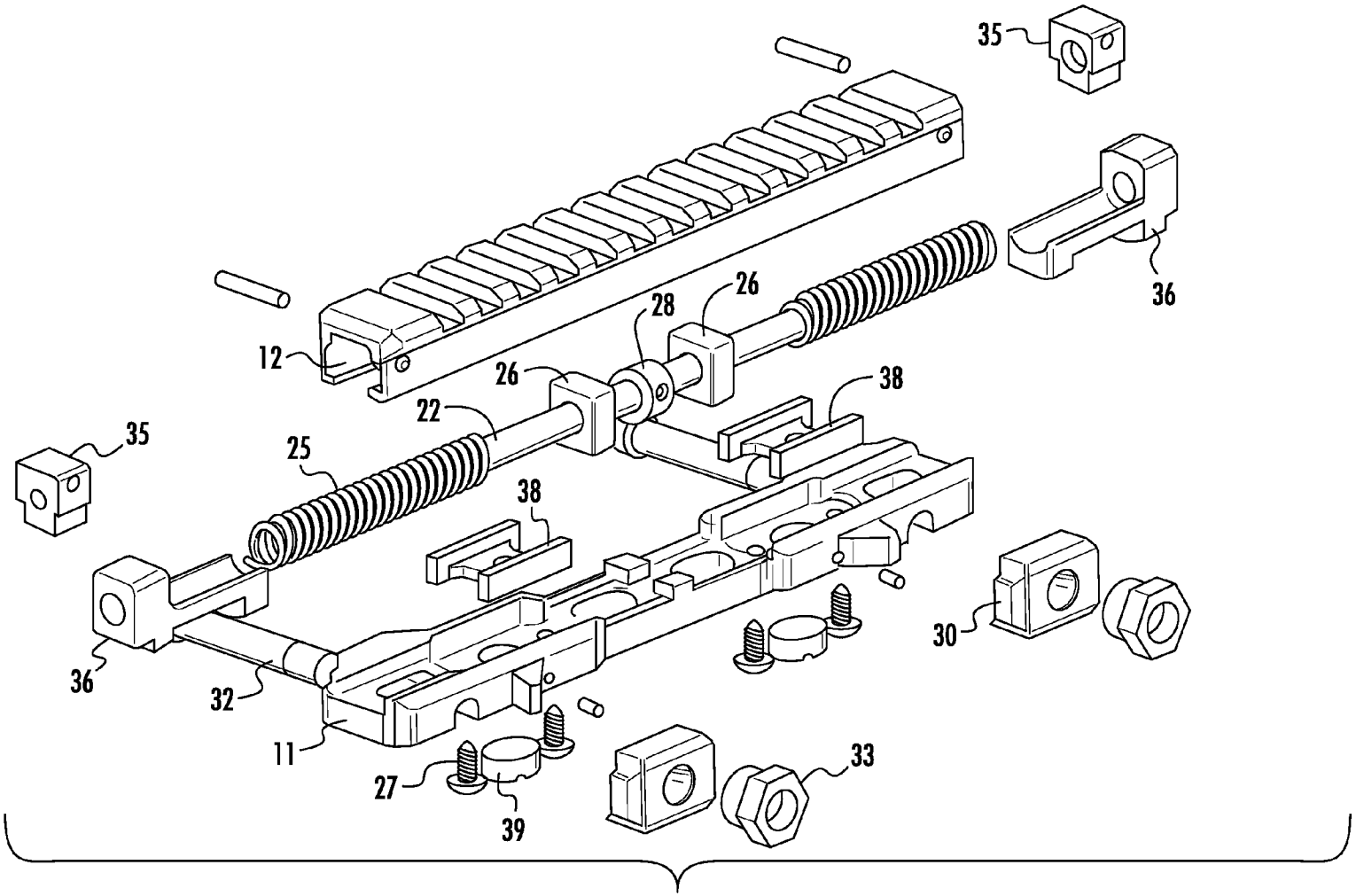
FIG. 5 is an exploded perspective view of the embodiment of FIG. 4.
Figure 6A:
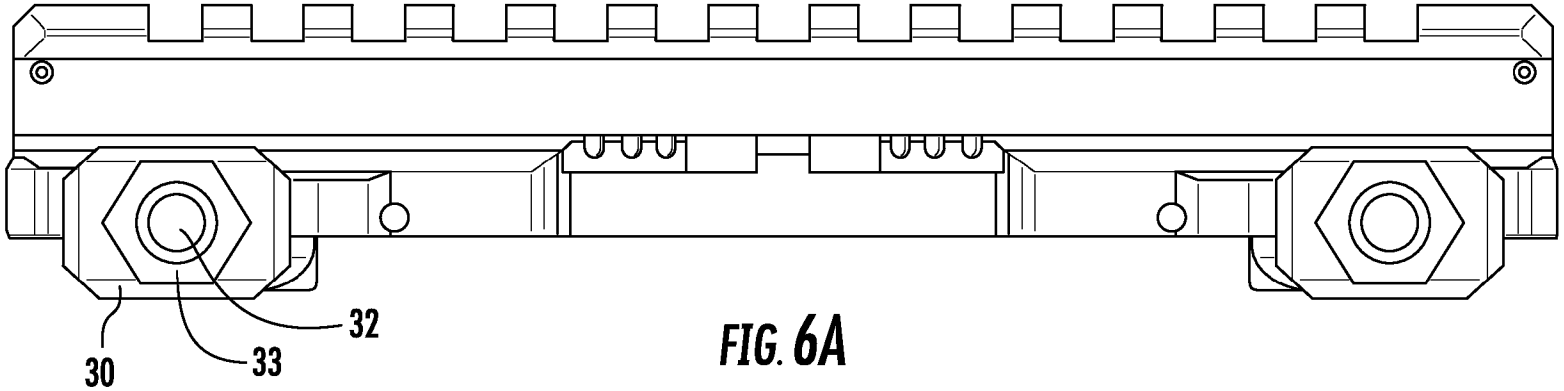
FIG. 6A is a side elevation view thereof.
Figure 6B:
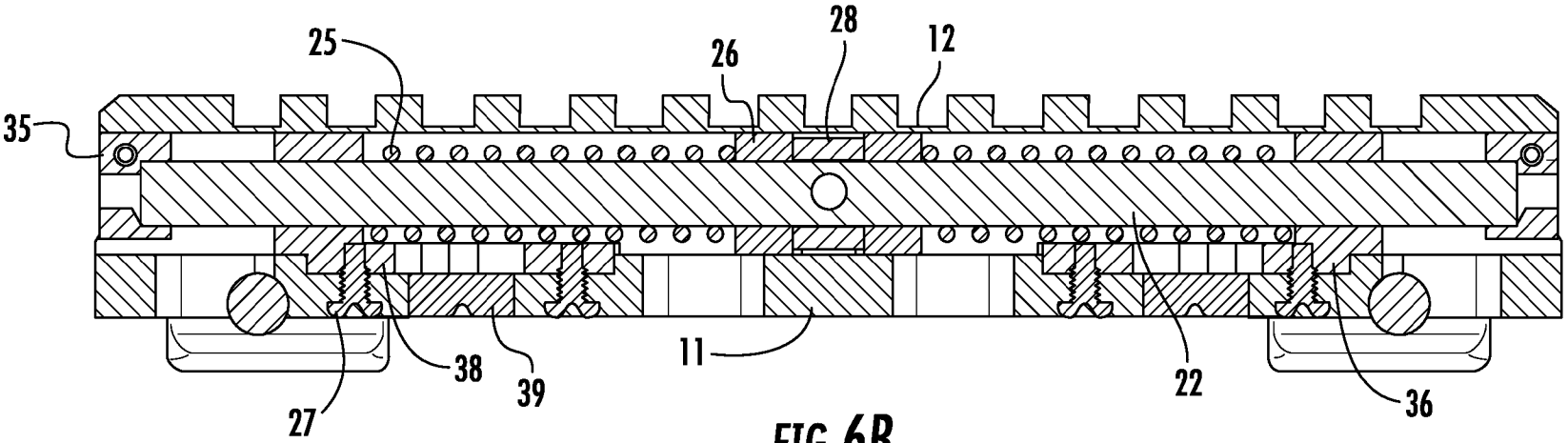
FIG. 6B is a cross-section, side elevation view thereof.
Figure 7:
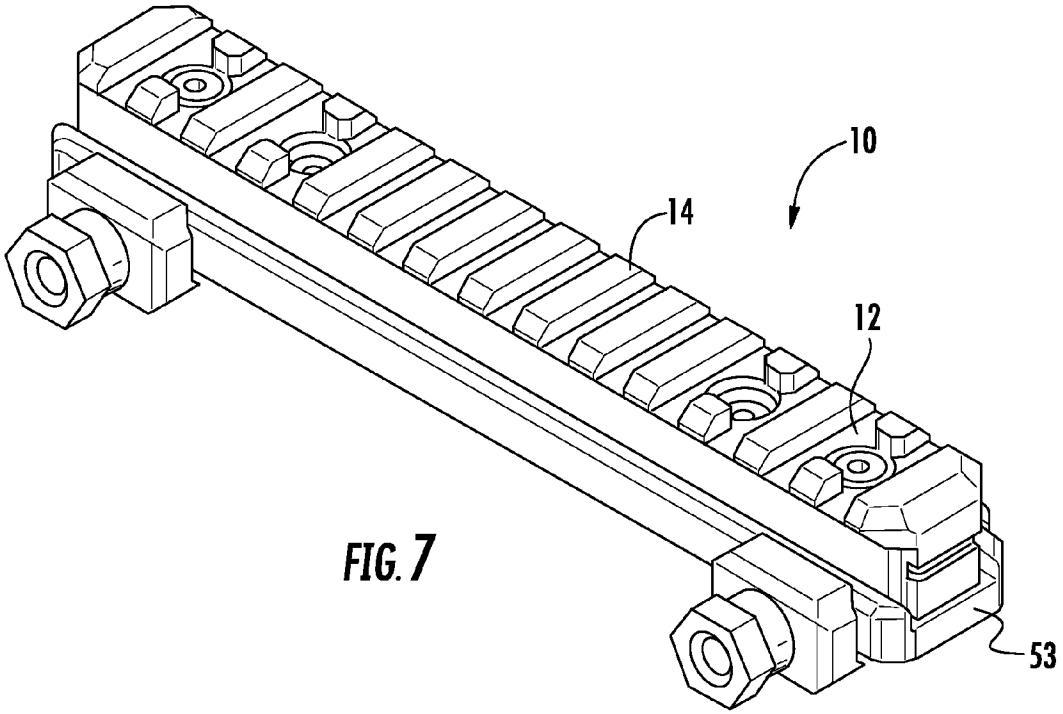
FIG. 7 is a perspective view of a third embodiment of a recoil force mitigating device for a firearm as presented herein.
Figure 8:
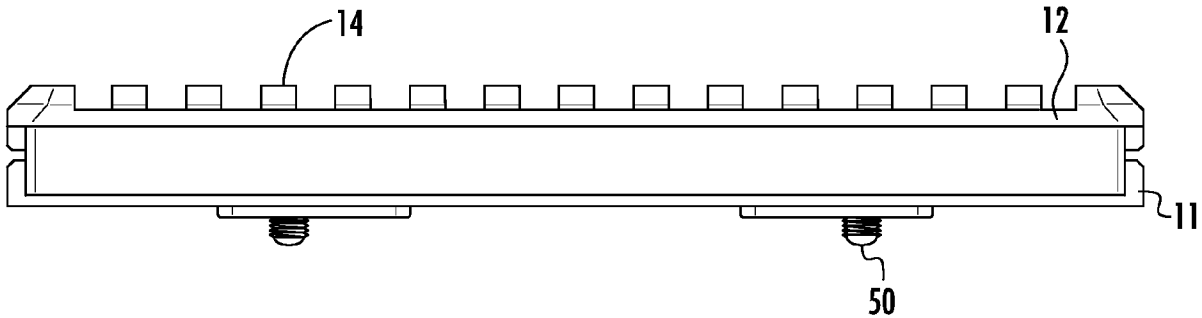
FIG. 8 is a side elevation view thereof.

A second embodiment is illustrated in FIGS. 4-6 wherein the recoil rail assembly 10 embodies a different recoil force mitigating means and is differently configured. More specifically, the second rail 12 is mounted on the central shaft 22 with the use of two end caps 35. The shaft 22 is received within two guides 36. The material used for the guide 36 and the shaft 22 are selected in the way to produce the lowest friction possible. At least one, and preferably at least two, cushion members 38 are provided and may be adjusted with a screw 39 in a way that they stabilize the rail 12 and substantially eliminate longitudinal rotation. In this design, the cushions 38 bias against the bottom of the rail 12 but they can be positioned in another way to be able, for example, to bias against the side walls 15 of the rail. A bushing 28 is fixed at the center of the shaft 22. When a shock occurs, the second rail 12 moves in the fore direction A relative to the shaft 22 of the first rail 11. The bushing 27 that is fixed on the shaft 22 carries the central stopper 26 and compresses the aft spring 25. When the force applied by the spring 7 is enough to absorb the recoil force, the spring pushes back the second rail 12 to the neutral position and the central stopper 26 abuts the protrusion 29 on the middle of the first rail 11. If the recoil force is not totally absorbed, the second rail 12 continues to move in the fore direction with the same action as described above until the second rail 12 stops at the neutral position. According to this embodiment, the recoil energy is absorbed by the spring but other ways such as a rubber material or a fluid can be used to absorb the energy.

Figure 10:
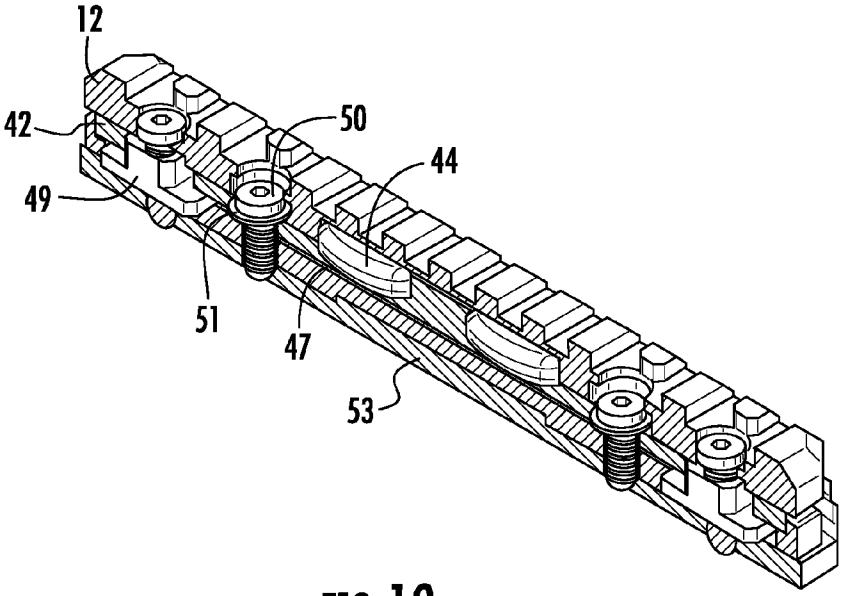
FIG. 10 is a cross-section, perspective view thereof.
Figure 9:
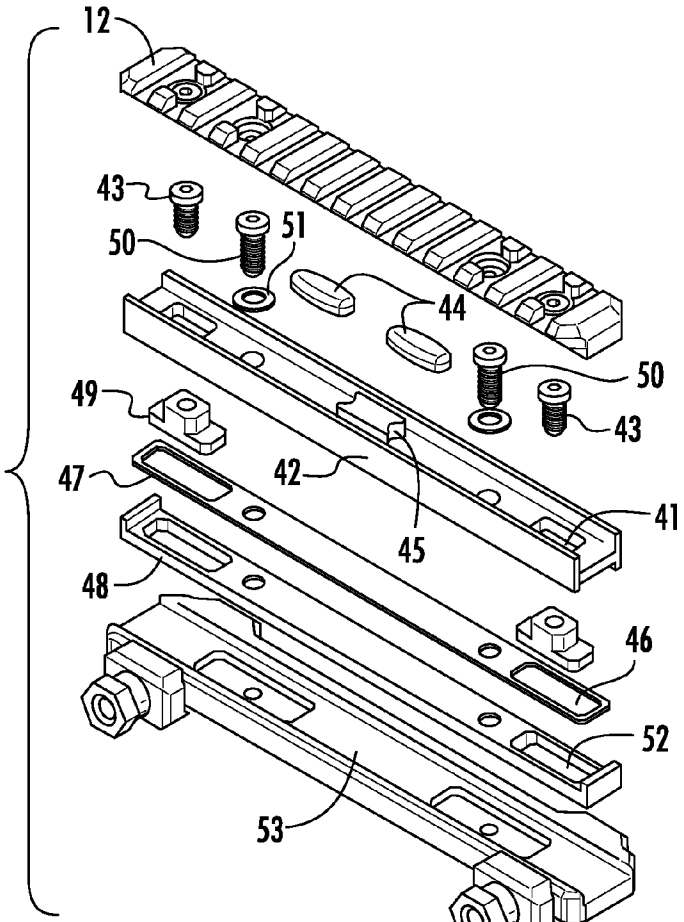
FIG. 9 is an exploded perspective view thereof.

A third embodiment is illustrated in FIGS. 7-12. According to this embodiment, the first and second rail arrangement and the recoil force mitigating device are modified. Additionally, the recoil rail assembly 10 includes a first or base rail 53, a second, slideable rail 12, and an intermediate rail 42. In contrast to previously described embodiments, there is not a central shaft. FIG. 9 provides an exploded view of the rail assembly. The second rail 12 is attached to the intermediate rail 42 with two screws 43 which cooperate with a respective T-nut or mating member 49. The intermediate rail 42 defines at least one, and preferably a pair of apertures 41 through which screws 43 extend. As apparent in FIG. 9, the aperture 41 is of sufficient dimensions to provide clearance for the screw 43 to move longitudinally to enable the second rail 12 to move relative to the intermediate rail 42. The T mating member 49 cooperates with the screw 43 to secure the second rail 12 to the recoil rail assembly while enabling relative movement of the second rail 12. Apertures 46 defined by membrane 47 and apertures 52 defined by the lower base member 48 provide sufficient clearances to enable movement of the second rail 12 in the longitudinal directions. As shown in FIG. 10, the screws 50 are countersunk so as not to preclude relative longitudinal movement of the second rail 12 and intermediate rail 42. The rail 42 is configured to prevent rotational movement of the second rail 12 along the longitudinal axis and along the vertical axis. The rail 42, as shown in FIG. 10 is secured to the mount attachment 53, lower base member 48, and the membrane 47 with screws 50.

Two urethane springs 44 are placed between the second rail 12 and the rail 42. The springs 44 allow the rail 12 to move in the longitudinal axis with a predetermined restriction. The springs 42 are secured on the slide by a centrally positioned and upwardly extending support 45 and which is received in a correspondingly configured cavity on the bottom surface of the rail 12. The springs 44 absorb the longitudinal peak load of a shock given by a firearm in both directions. The shape, dimensions and material of the springs 44 can be changed to be able to absorb different sizes of peak load.

Figure 12:
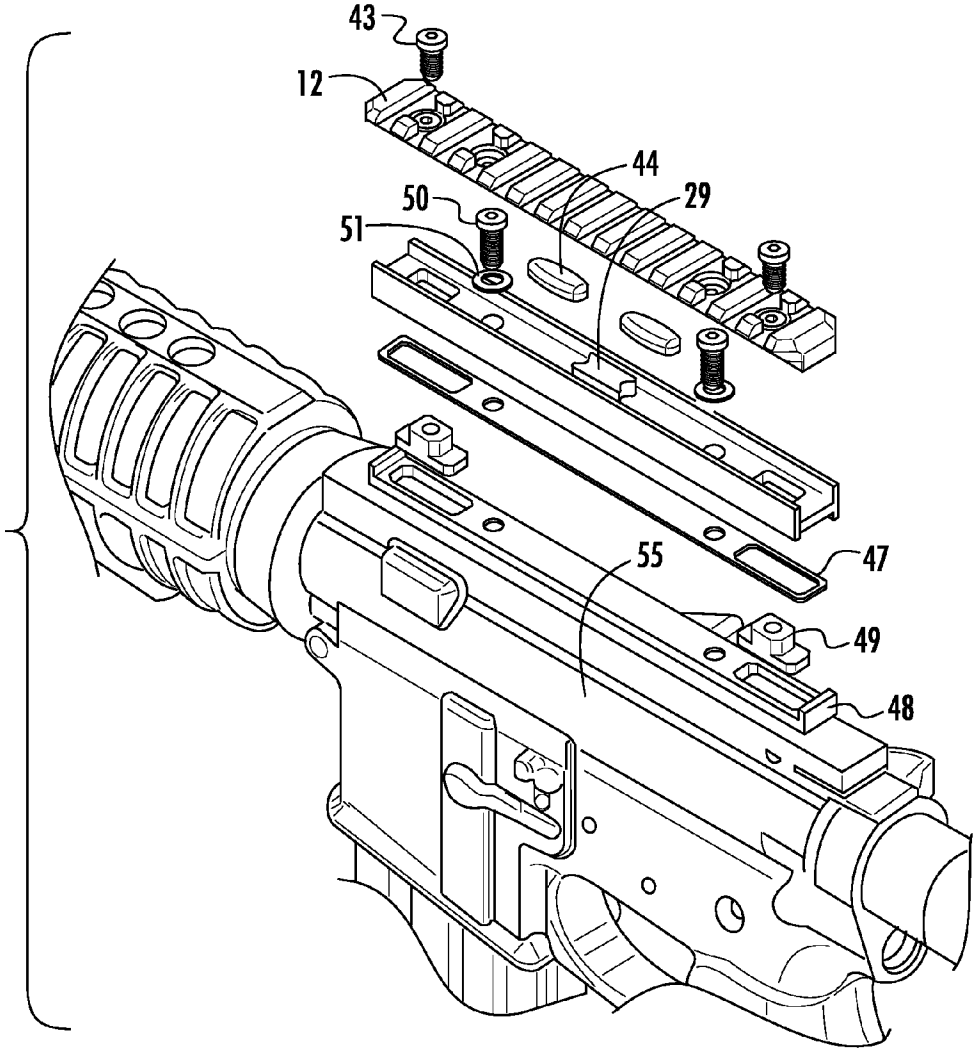
FIG. 12 is a perspective view of the fourth embodiment illustrating an exploded view of the recoil force mitigating device mounted on a firearm.
Figure 13:
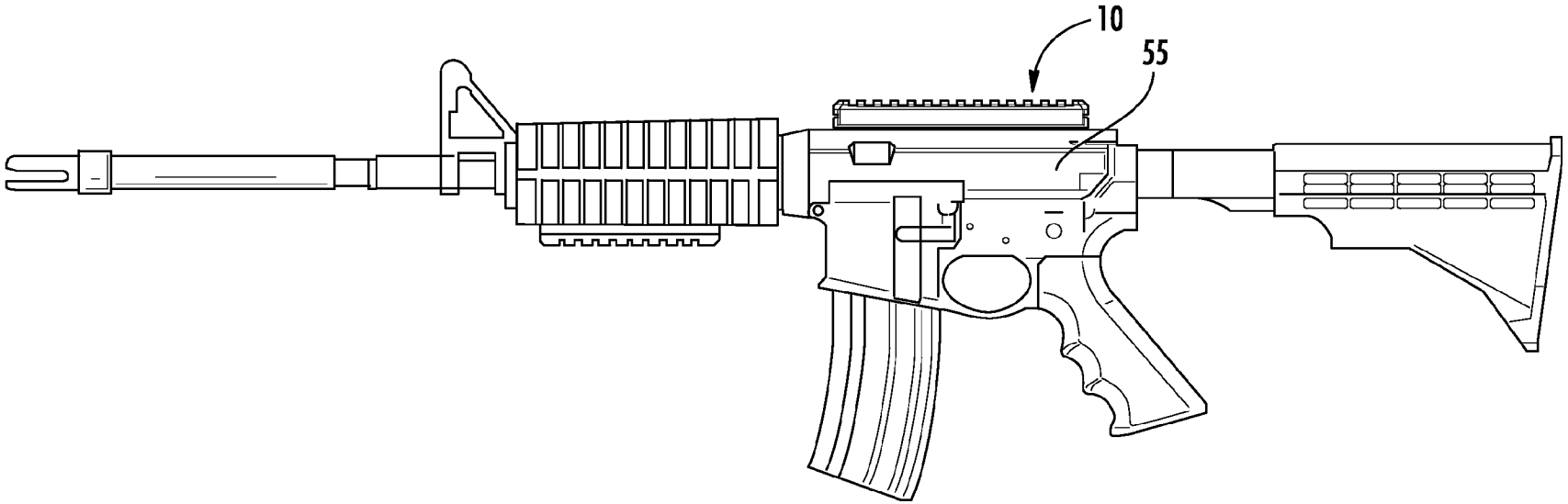
FIG. 13 is a side elevation view, assembled.

A thin membrane, in the form of a soft rubber film 42, is placed between the rail 42 and a lower base member 48. The base member 48 and the film membrane 47 are configured to provide sufficient clearance between these members and the mating member 49. Two screws 50 and two washers 51 are used to attach the rail 42 to the mount attachment 53. The membrane 47 facilitates absorption of the peak load in the vertical axis. It also absorbs any rotational peak load along the transverse axis and the longitudinal axis. The thickness, dimension and material of the membrane 47 may be altered to absorb different values of peak load. The mount attachment 53 is beneficial where the recoil rail assembly 10 is mounted to another firearm rail. The mount attachment 53 may be secured directly to the firearm receiver 55 as shown in FIGS. 12 and 13. As shown, screws 50 are secured directly to the receiver 55.

Figure 15:
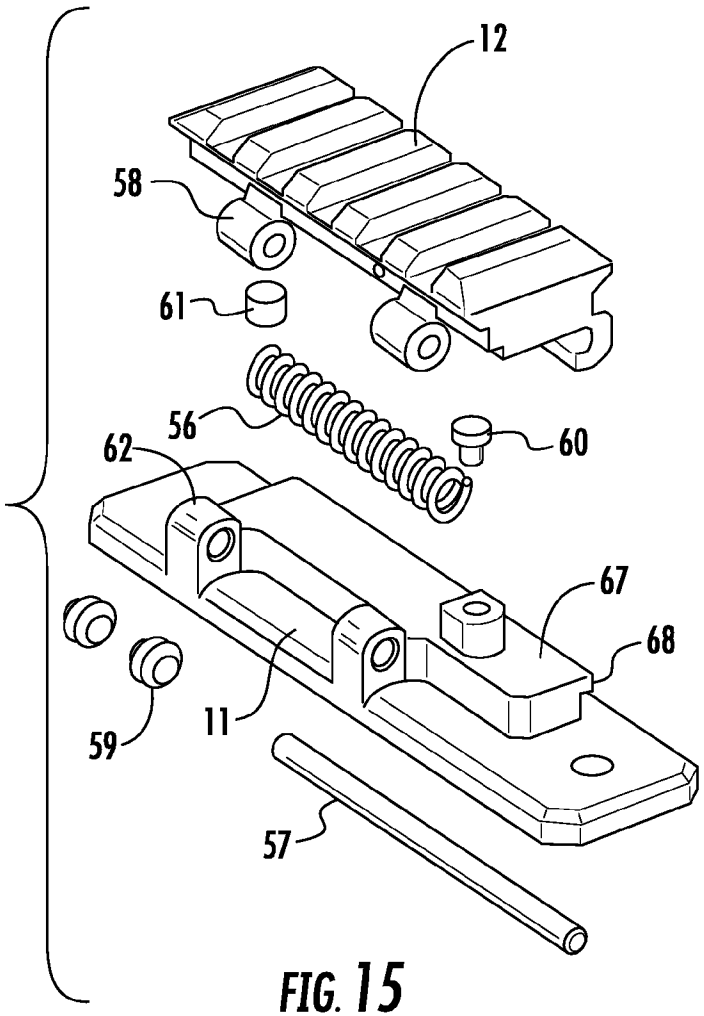
FIG. 15 is an exploded view thereof.
Figure 14:
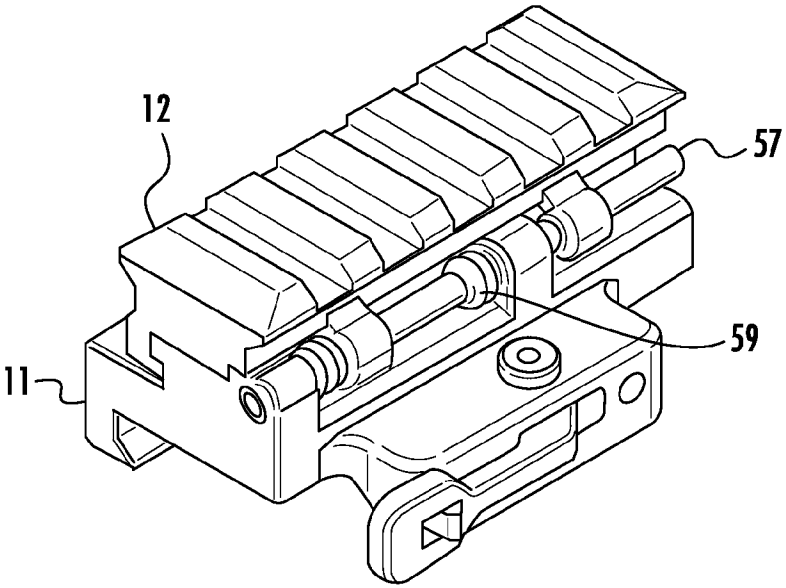
FIG. 14 is a perspective view of a fifth embodiment of a recoil force mitigating device for a firearm as presented herein.
Figure 16:
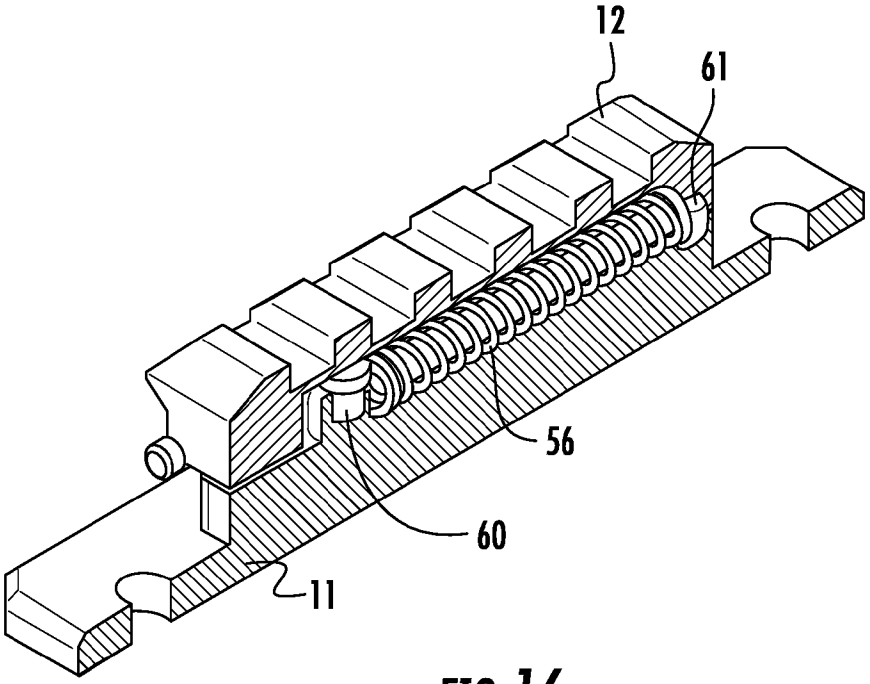
FIG. 16 is a perspective view, partially broken away thereof.

A fourth embodiment is illustrated in FIGS. 14-19. This embodiment includes a novel configuration of cooperating rails, a novel mounting configuration, and a novel recoil force mitigating means. More specifically, the recoil rail assembly 10 includes a first, base rail 11 and a cooperating second rail 12 for supporting accessories thereon. Recoil force mitigating means includes, preferably, a single coil spring 56 positioned within a cavity define by said first 11 and second rails 12 and remote from the shaft 57 for holding the rails together. One exemplary variation is shown in FIGS. 14-16, the first, base rail 11 according to this embodiment has securing member 67 extending upwardly from its upper surface and the securing member 67 include an outwardly extending mating member 68. The second rail 12 includes a longitudinally extending mating member 69 correspondingly configured as to the first rail mating member 68 so that the two form a secure fit as shown in FIG. 14. The second rail 12 also includes a pair of side tabs 58 including central bores for receiving the externally positioned shaft 57.

The second rail 12 is attached to the base rail 11 with the shaft 57. A side tab 58 links the rail 12 with corresponding side tabs 62 of the first rail 11 and allows the second rail 12 to be stabilized and eliminates or minimizes longitudinal rotation. As shown in FIG. 16, the spring 56 is positioned within a cavity defined by the first 11 and second 12 rails which also houses a stop 60. When recoil forces occur, the second rail 12 moves in the aft direction B and compresses the spring 56 against stop 60. When the force applied by the spring is enough to absorb the recoil energy, the spring 56 urges the rail 12 to its initial position. At least one soft rubber, cylindrical stopper 61 is used to absorb the shock at both ends of the stroke of the first rail 11.

Figure 17:
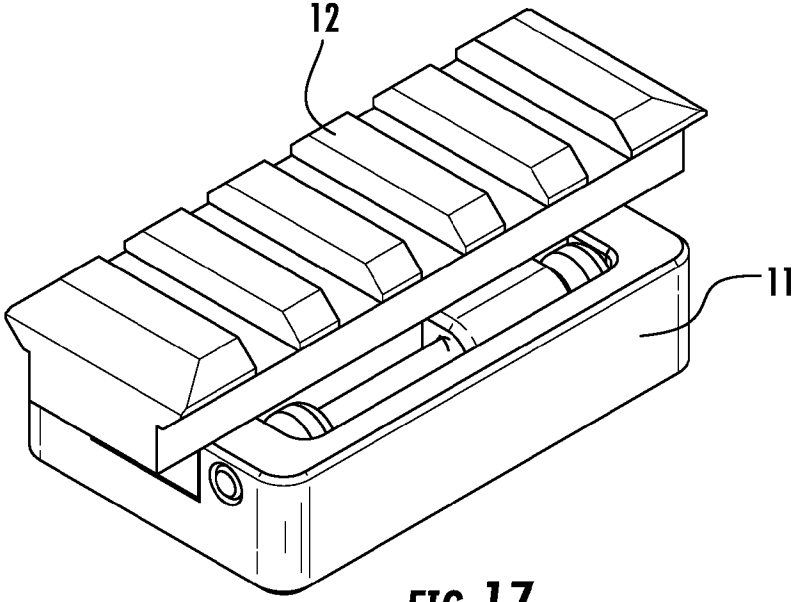
FIG. 17 is a perspective view of a variation of the fifth embodiment of a recoil force mitigating device for a firearm as presented herein.
Figure 19:
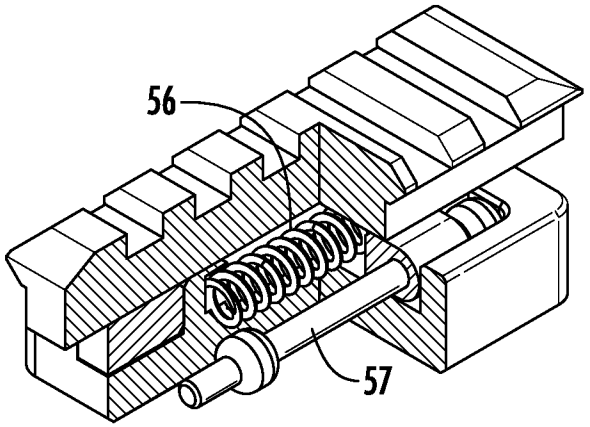
FIG. 19 is perspective view, partially broken away, thereof.
Figure 18:
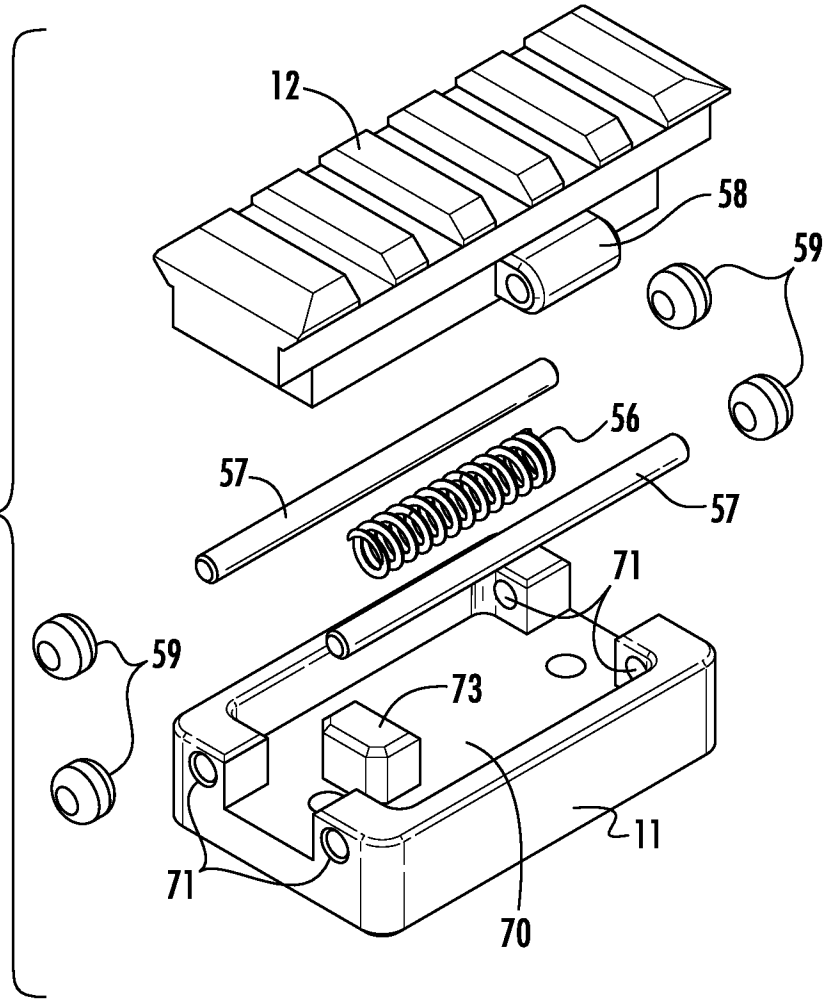
FIG. 18 is an exploded view thereof.

Another variation of this embodiment is shown in FIGS. 17-19. According to this embodiment, the first rail is uniquely configured so as to define a cavity 70. A pair of shafts 57 is provided in the illustrated embodiment. It is within the scope of the present invention to utilize a single or a plurality of shafts. The cavity 70 is configured so as receive the spring 56 and the pair of shafts 57. The shafts 57 are received by a respective one of a pair or second rail side tabs 58 and this configuration limits or prevents relative rotational movement of the second rail 12 relative to the first rail 11. The first rail 11, which is mounted to the firearm, defines two pairs of apertures 71 for receipt of the respective shaft 57. A stop 73 cooperates with the spring 56 under compressive forces resulting from recoil forces. Cushions 59 are also provided to absorb residual forces resulting from recoil or other forces exerted upon the firearm.

According to this embodiment, the main recoil energy is absorbed by the spring but other ways such as a rubber material can be used to absorb the energy. The recoil rail base 1 can be mounted directly to a firearm or a firearm accessory with the use of screws or it can be machined directly to the firearm or firearm accessory. Or, it can be attached with a quick release system.

Figure 11:
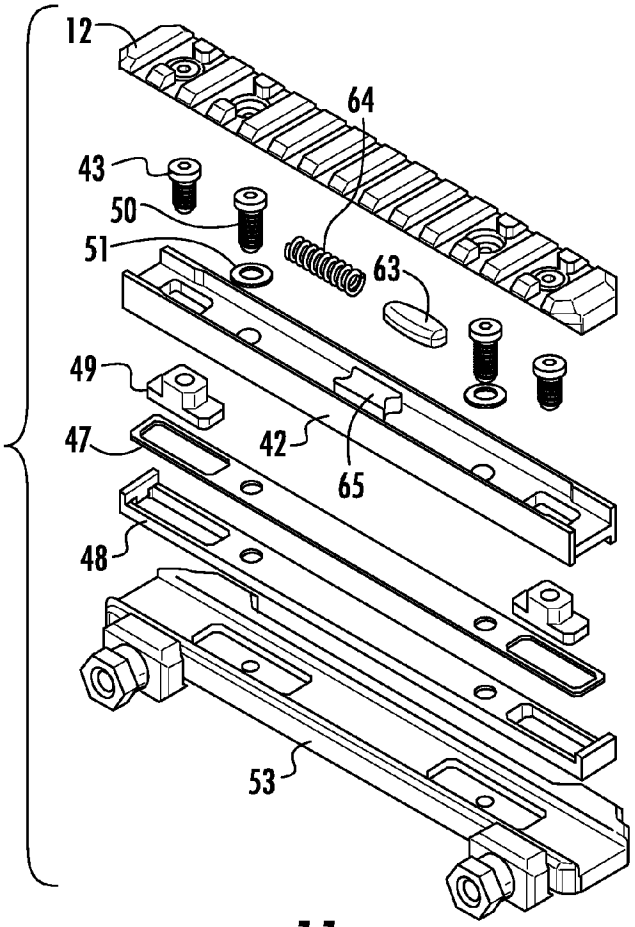
FIG. 11 is an exploded view of the fourth embodiment of a recoil force mitigating device for a firearm as presented herein.

A fifth embodiment is illustrated in FIG. 11. FIG. 11 presents an exploded view of the rail assembly 10. The upper rail 12 is attached to an intermediate rail 42 with two screws 43 and mating members 49. Sufficient tolerances are provided between the mating member 49, the rail 12 and the rail 42 to enable rail 12 to move longitudinally along the rail 42. The slide is configured so as to prevent rotation of the rail 12 along the longitudinal axis and the vertical axis.

A urethane spring 63 and a coil spring 64 are positioned between the rail 12 and the rail 42. These springs allow the rail 12 to move in the longitudinal axis with a predetermined restriction. The springs 63 and 64 are positioned by a centrally positioned and vertically extending support 65 positioned on the rail 42 and received within a correspondingly configured cavity defined by the bottom said of the rail 12. Hybrid use of a urethane spring 63 and coil spring 64 is employed to absorb different loads and control the length of rail 12 travel. These springs are used to absorb the longitudinal peak load of shock resulting from the firearm discharge, in both directions. The shape, dimensions and material of these springs can be changed to be able to absorb different sizes of peak load.

A soft rubber film 47 is positioned between the rail 42 and the lower base 48. The base 48 and the film 47 are configured with appropriate clearances to accommodate the mating member 49. Two screws 50 and two washers 51 are used to secure the rail 42 to the mount attachment 58. The rubber film 47 is used to absorb the peak load in the vertical axis. It can also absorb the rotational peak load along the transverse axis and along the longitudinal axis. The thickness, dimension and material of the film 47 can be changed to be able to absorb different values of peak load.

Figure 20:
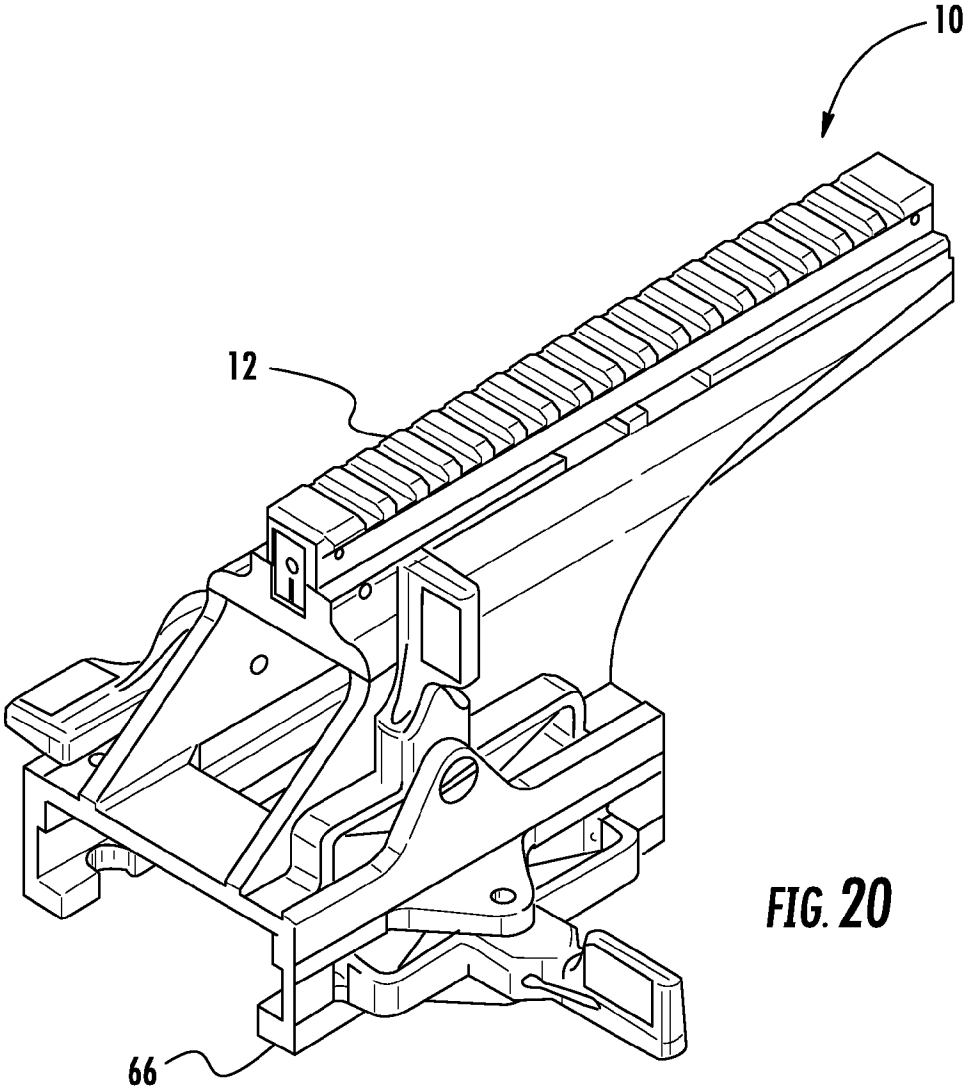
FIG. 20 is a perspective view of various embodiments of the recoil force mitigating device utilizing a clamp system for mounting to a firearm as presented herein.

A sixth embodiment is illustrated in FIG. 20. The recoil rail assembly 10 is directly attached to a clamp system or a bracket 66 to attach or clamp the rail to the body of the recipient device. The recoil rail assembly 10 may be used in conjunction with any of the recoil rail assemblies and/or recoil force mitigating means described herein.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

We claim:

1. A recoil rail assembly for a firearm for mitigating recoil forces comprising:

a first rail configured to mount to the firearm, said first rail including a longitudinally extending body and upwardly extending side walls;

a second rail slideably mounted to said first rail and including a longitudinally extending body having an upper surface including a Picatinny rail configured for mounting a firearm accessory thereon and downwardly extending sidewalls for cooperating with said first rail, said first and second rails defining a cavity there between and wherein said second rail is moveable relative to said first rail along the longitudinal length thereof; and a recoil force mitigating assembly positioned within said cavity defined by said first and second rails and comprising a shaft extending longitudinally within said cavity, at least one elastically deformable member mounted along the length of said shaft and configured to absorb forces when said second rail moves in the longitudinal direction along the length of said first rail.

2. A recoil rail assembly according to claim 1 wherein said elastically deformable member is a spring.

3. A recoil rail assembly according to claim 1 further comprising at least one block support freely supported on said shaft so as to move along the length thereof, said block support configured to prevent rotational movement of said second rail relative to said first rail.

4. A recoil rail assembly according to claim 3 wherein said recoil force mitigating assembly comprises a pair of said block supports, positioned on said shaft, each of said block supports comprising a pair of said flanges for cooperating with each of said second rail sidewalls.

5. A recoil rail assembly according to claim 2 wherein said recoil force mitigating assembly includes a pair of springs positioned on said shaft and a pair of stops for contacting and elastically deforming said springs under forces.

6. A recoil rail assembly according to claim 5 further comprising a central bushing positioned on said shaft between said pair of stops.

7. A recoil rail assembly according to claim 1 further comprising at least one restraining member wherein said restraining member is a guide for receiving a respective end of said shaft and for limiting rotational movement of said second rail and positioned outwardly from said spring along the length of said shaft.

8. A recoil rail assembly according to claim 7 wherein a portion of said guide extends below said shaft and comprising an intermediate member wherein said intermediate member is configured to cooperate with said guide and at least one of said second rail sidewalls to substantially limit relative rotational movement between the two rails.

9. A recoil rail assembly according to claim 8 further comprising a pair of said elastically deformable members on said shaft and a pair of guides positioned on outer ends of said springs.

10. A recoil rail assembly according to claim 1 further including a pair of end caps configured for receipt of said shaft for securing said shaft within said recoil rail assembly.

11. A recoil rail assembly according to claim 1 further comprising means for securing said recoil rail assembly to a firearm.

12. A recoil rail assembly according to claim 9 further comprising a pair of intermediate members for cooperating with each of said pair of guides.

13. A recoil rail assembly according to claim 1 wherein said first rail comprises a securing member extending upwardly from an upper surface thereof and having at least one tab defining a first bore, said second rail comprising a mating member extending substantially along a side thereof for cooperating with said mating member of said first rail so as to define said cavity, and at least one tab extending outwardly therefrom and defining a second bore, said rail assembly comprising a shaft extending longitudinally along a length of said second rail and through said first and second bores of said tabs, said shaft supported by said tabs so as to permit relative longitudinal movement of said shaft within said first and second bore, and said recoil force mitigating assembly comprising at least one elastically deformable member mounted within said cavity for absorbing recoil forces.

14. A recoil rail assembly according to claim 13 wherein said elastically deformable member is a spring.

15. A recoil rail assembly according to claim 13 wherein said recoil force mitigating means further includes at least one bushing moveably positioned on said shaft between said spring and said at least one tab.

16. A recoil rail assembly according to claim 13 wherein said second rail includes a pair of said tabs and said first rail includes a pair of said tabs.

17. A recoil rail assembly according to claim 13 further comprising a stop extending upwardly from said first rail securing member and extending within said cavity to cooperate with said elastically deformable member under recoil forces.

18. A recoil rail assembly for mitigating recoil forces comprising:

a first rail configured to mount to a firearm, said first rail including a longitudinally extending body defining a recoil force mitigating means cavity;

a second rail slideably mounted to said first rail and including a longitudinally extending upper surface configured for mounting a firearm accessory thereon, a mating member, said first and second rail members having mating configurations to facilitate relative longitudinal movement of said second rail relative to said first rail;

at least one shaft extending longitudinally along a length of said second rail and cooperating with said mating member, said shaft securing said first and second rails to prevent relative rotational movement of said second rail; and recoil force mitigating means comprising and at least one elastically deformable member mounted within said cavity for absorbing recoil forces.

19. A recoil rail assembly according to claim 18 wherein said at least one mating member is a tab defining a bore and said shaft extends through said bore.

20. A recoil rail assembly according to claim 19 wherein said tab extends outwardly from a side edge of said second rail.

21. A recoil rail assembly according to claim 19 wherein said assembly includes a pair of said shafts and said second rail includes a pair of said tabs for receipt of a respective one of said pair of shafts.

22. A recoil rail assembly according to claim 21 wherein said cavity defines a plurality of shaft seats for receipt of each end of said at least one shaft.

23. A recoil rail assembly according to claim 22 wherein said cavity defines at least two sets of shaft seats, each set having a pair of apertures positioned on opposing ends of said cavity wherein a respective one of said shafts is positioned within a set of shaft seats so as to extend longitudinally substantially along the length of said cavity and said shafts extend substantially parallel to one another.

24. A recoil rail assembly according to claim 18 wherein said elastically deformable member is a spring.

25. A recoil rail assembly according to claim 24 wherein said cavity includes a stop extending upwardly therefrom for cooperating with said spring.

26. A recoil rail assembly according to claim 18 further comprising a cushioning member for absorbing forces.

27. A recoil rail assembly for mitigating recoil forces comprising:

firearm mounting means for mounting said recoil rail assembly to a firearm;

a base member configured to cooperate with said mounting means;

an intermediate rail including a longitudinally extending body and upwardly extending side walls and having a support extending upwardly from a central portion thereof;

a second rail slideably mounted to said intermediate rail and including a longitudinally extending body and having an upper surface configured for mounting a firearm accessory thereon and sidewalls for slideable cooperating with said sidewalls of said intermediate rail, wherein said second rail is moveable relative to said intermediate rail along the longitudinal length thereof and relative rotational movement of said second rail is prevented, said rails defining a cavity there between and said support being positioned within said cavity; and recoil force mitigating means positioned within said cavity defined by said intermediate and second rails and comprising at least one elastically deformable member for cooperating with said support under recoil forces, said recoil force mitigating means further including at least one restraining member positioned on said intermediate rail and being configured to cooperate with said intermediate rail support when recoil forces are applied to said assembly to facilitate said relative longitudinal movement of said second rail and to prevent relative rotational movement of said second rail.

28. A recoil rail assembly according to claim 27 further comprising a resilient member positioned between said base member and said intermediate slide for absorbing undesirable forces thereto.

29. A recoil rail assembly according to claim 28 wherein said resilient member is a resilient membrane which extends along a substantial length of said base member and said intermediate rail.

30. A recoil rail assembly according to claim 27 wherein said recoil force mitigating means includes a pair of elastomeric members positioned on opposing sides of said intermediate slide support.

31. A recoil rail assembly according to claim 30 wherein at least one of said pair of elastomeric supports is a spring.

32. A recoil rail assembly according to claim 30 wherein at least one of said pair of elastomeric supports is formed of an elastically deformable material.

33. A recoil rail assembly according to claim 27 further comprising a first securing member for securing said intermediate rail, base member, and firearm mounting means and a second securing member for cooperating with at least one locking nut which is associated with said intermediate slide and which cooperates with said second securing member for slideable securing said second rail to said intermediate rail to enable relative longitudinal movement there between.

34. A recoil rail assembly according to claim 33 comprising a pair of said locking nuts associated with a pair of said second securing members.

35. A recoil rail assembly according to claim 1 wherein said downwardly extending sidewalls of said second rail cooperate with and are slideably connected to said upwardly extending sidewalls of said first rail.

36. A recoil rail assembly according to claim 35 further comprising a supporting member for cooperating with said first and second rails to connect said first and second rails wherein said second rail and said supporting member are configured to move longitudinally along the length of said first rail.

37. A recoil rail assembly according to claim 36 wherein said second rail sidewall includes a flange extending inwardly from said second rail sidewall and said supporting member includes a corresponding protrusion for cooperating with said sidewall flange and said first rail sidewall is configured to define a seat for receipt of a correspondingly configured bottom portion of said supporting member for supporting said second rail on said first rail and permitting relative longitudinal movement between said rails.

38. A recoil rail assembly according to claim 1 wherein said elastically deformable member is formed of an elastomeric material.

39. A recoil rail assembly according to claim 2 further comprising at least one supporting member secured to said second rail and freely supported on said shaft and positioned outwardly from said spring along the length of said shaft and for connecting said first and second rails.

40. A recoil rail assembly according to claim 3 wherein said block support comprises at least one flange extending outwardly therefrom and said second rail sidewall defines a seat for receipt of said flange.

41. A recoil rail assembly according to claim 3 wherein said block support has a bottom portion and said first rail upper surface is configured to receive said block support bottom portion to prevent relative rotational movement between said first and second rails.

* * * * *